US011320123B2

(12) United States Patent
Rego et al.

(10) Patent No.: US 11,320,123 B2
(45) Date of Patent: May 3, 2022

(54) NIGHT LIGHT ROTATABLE TO EXPOSE OR CONCEAL OUTLET

(71) Applicants: Daniel Rego, Dallas, TX (US); Lidong Xie, Ningbo (CN)

(72) Inventors: Daniel Rego, Dallas, TX (US); Lidong Xie, Ningbo (CN)

( * ) Notice: Subject to any disclaimer, the term of this patent is extended or adjusted under 35 U.S.C. 154(b) by 220 days.

(21) Appl. No.: 16/111,154

(22) Filed: Aug. 23, 2018

(65) Prior Publication Data

US 2020/0063952 A1 Feb. 27, 2020

(51) Int. Cl.

| | |
|---|---|
| ***F21V 21/30*** | (2006.01) |
| ***F21V 23/06*** | (2006.01) |
| ***F21V 23/04*** | (2006.01) |
| ***F21Y 115/20*** | (2016.01) |
| ***F21Y 115/10*** | (2016.01) |

(52) U.S. Cl.

CPC ..... *F21V 21/30* (2013.01); *F21V 23/045* (2013.01); *F21V 23/0464* (2013.01); *F21V 23/06* (2013.01); *F21Y 2115/10* (2016.08); *F21Y 2115/20* (2016.08)

(58) Field of Classification Search

CPC .... F21V 21/30; F21V 23/045; F21V 23/0464; F21V 23/06; F21Y 2115/20; F21Y 2115/10

USPC ..... 362/368

See application file for complete search history.

(56) References Cited

U.S. PATENT DOCUMENTS

2004/0058562 A1* 3/2004 Hwang ..... H01R 33/94 439/11
2007/0236961 A1* 10/2007 Sasson ..... F21S 8/035 362/641
2017/0356638 A1* 12/2017 Mousavi ..... F21V 23/06

* cited by examiner

*Primary Examiner* — Andrew J Coughlin
*Assistant Examiner* — Jessica M Apenteng
(74) *Attorney, Agent, or Firm* — Terry Booth

(57) ABSTRACT

The present invention is a night light that plugs into an electrical outlet and has means that allow the night light body, without unplugging the night light, alternatively to conceal from view the entire electrical receptacle in a first orientation and to expose one of the electrical receptacle's outlets for use in a second orientation. The invention thus serves to conceal electrical receptacles in an aesthetically pleasing way while operating as a night light. It can be reoriented from that position, without removing it from the electrical outlet into which it is plugged, to expose for use by another electrical device the electrical outlet of the electrical receptacle not being used by the night light, while continuing to function as a night light.

16 Claims, 7 Drawing Sheets

NIGHT LIGHT ROTATABLE TO EXPOSE OR CONCEAL OUTLET

CROSS-REFERENCE TO RELATED APPLICATIONS

This application claims the benefit of provisional patent application No. 62/549,584, filed on Aug. 24, 2017, by the present inventors.

BACKGROUND OF THE INVENTION

Field of the Invention

The present invention relates generally to night lights, and more specifically to a night light that plugs into an electrical outlet and has means that allow the night light body, without unplugging the night light, alternatively to conceal from view the entire electrical receptacle in a first orientation and to expose one of the electrical receptacle's outlets for use in a second orientation.

Discussion of the Prior Art

Night lights are long known in the prior art. They are useful in providing low levels of light that, without disrupting sleep, facilitate safer movement in darkness, enhance a space's ambiance and enhance feelings of security for those having emotional concerns with darkness. Some of the prior art discloses night lights that function automatically to turn on when ambient light levels are low and to turn off when ambient light levels are high. Other prior art discloses means to restrict the unintended removal of night lights from electrical outlets. Yet other prior art discloses night lights with rotatable prongs that allow the bodies of the night lights to have variable orientations to the electrical receptacle into which they are plugged.

Standard alternating current utility electrical receptacles commonly used in homes and other buildings, are utilitarian in appearance. Owners and occupiers of homes and businesses are often desirous of furnishing and decorating their homes and businesses in ways that enhance the aesthetic motif or character of that home or business both for the owner or occupier's comfort and pleasure and also for the comfort and pleasure of visitors to such spaces. The importance of that aesthetic factor extends to electrical receptacles. That importance is demonstrated by the availability of numerous different designs of wall cover plates to surround the outlets of electrical receptacles.

U.S. Pat. No. 5,727,953 to Pasholk discloses a night light that plugs into an outlet of an electrical receptacle. The night light is utilitarian in appearance and does not conceal the view of the electrical receptacle. Multiple other patents disclose night lights or aroma dispensing devices which do not conceal the entire electrical receptacle into which they are plugged.

Night lights that plug into electrical receptacles often block or restrict the use of the outlet that is not being used by the night light. The night light therefore has to be removed from the electrical receptacle in order to plug another electrical device into the electrical receptacle.

Accordingly, there is a clearly felt need in the art for a night light that plugs into an electrical outlet and has means that allow the night light body, without unplugging the night light, alternatively to conceal from view the entire electrical receptacle in a first orientation and to expose one of the electrical receptacle's outlets for use in a second orientation.

BRIEF SUMMARY OF THE INVENTION

The present invention comprises a night light that plugs into an electrical outlet and has means that allow the night light body, without unplugging the night light, alternatively to conceal from view the entire electrical receptacle in a first orientation and to expose one of the electrical receptacle's outlets for use in a second orientation. The invention thus serves to conceal electrical receptacles in an aesthetically pleasing way while operating as a night light. It can be reoriented from that position, without removing it from the electrical outlet into which it is plugged, preferably by rotating the body of the night light in relation to the orientation of the electrical receptacle, to expose for use by another electrical device the electrical outlet of the electrical receptacle not being used by the night light. While in the orientation which exposes an outlet for use by another electrical device, the night light continues to be energized and to serve one of its functions as a night light.

These and additional objects, advantages, features and benefits of the present invention will become apparent from the following specification.

Figure 7:
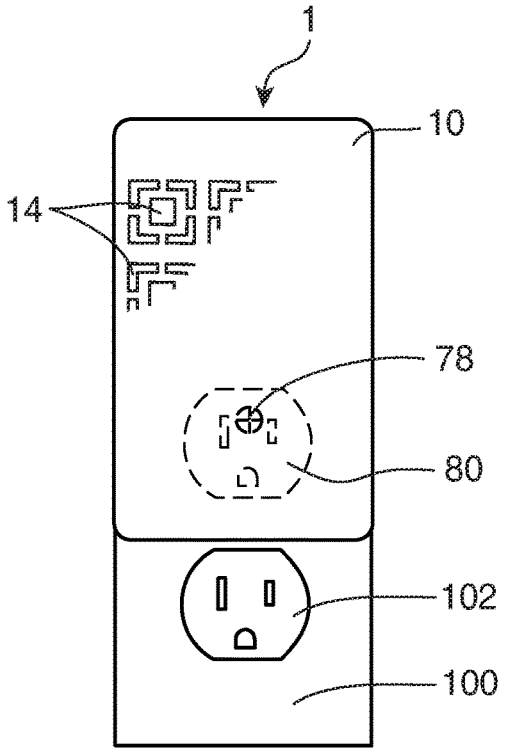
FIG. 7 depicts a front view of a night light rotatable to expose or conceal outlet plugged into an upper outlet of a standard electrical receptacle in an orientation in which an outlet of the electrical receptacle is exposed and available for use by another electrical device, in accordance with the present invention.
Figure 8:
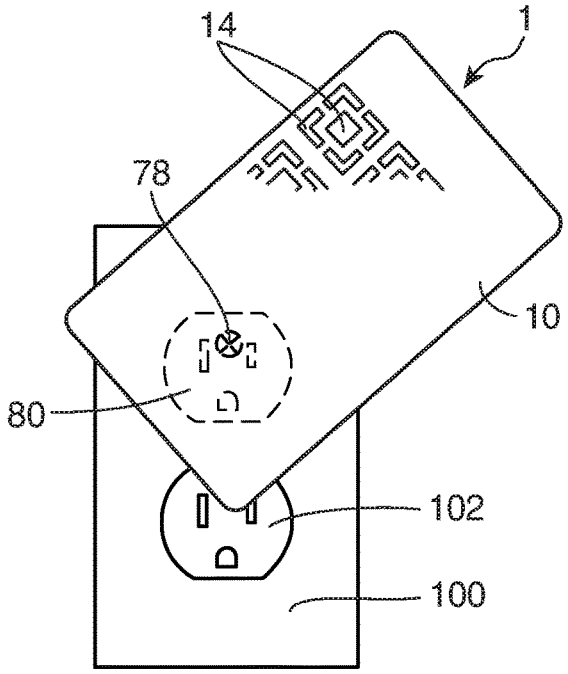
FIG. 8 depicts a front view of a night light rotatable to expose or conceal outlet plugged into an upper outlet of a standard electrical receptacle rotated approximately 45 degrees clockwise from the orientation depicted in FIG. 7, in accordance with the present invention.
Figure 9:
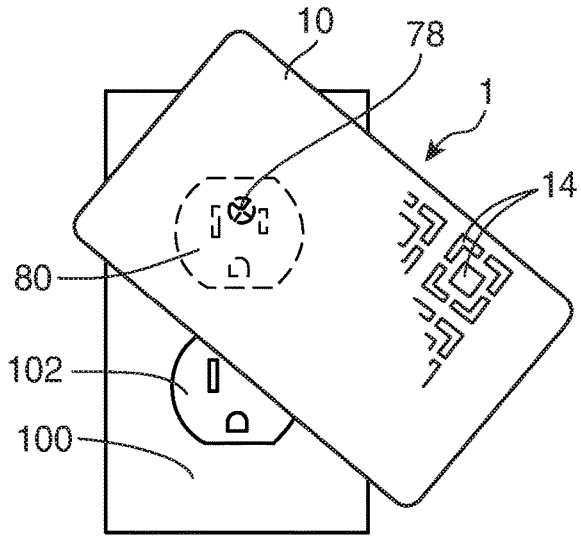
FIG. 9 depicts a front view of a night light rotatable to expose or conceal outlet plugged into an upper outlet of a standard electrical receptacle rotated approximately 135 degrees clockwise from the orientation depicted in FIG. 7, in accordance with the present invention.
Figure 10:
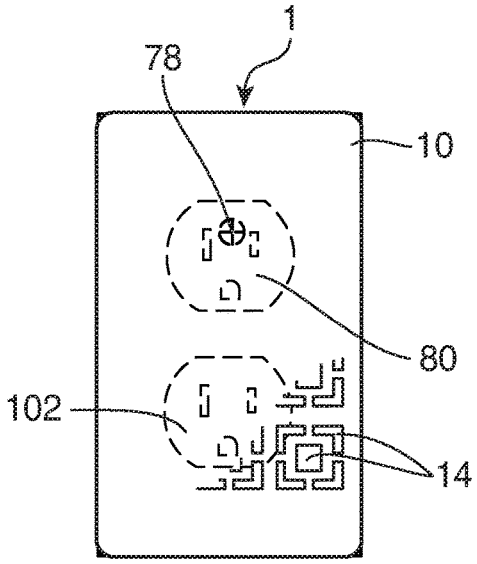

FIG. 10 depicts a front view of a night light rotatable to expose or conceal outlet plugged into an upper outlet of a standard electrical receptacle rotated approximately 180 degrees clockwise from the orientation depicted in FIG. 7, in accordance with the present invention.

Figure 11:
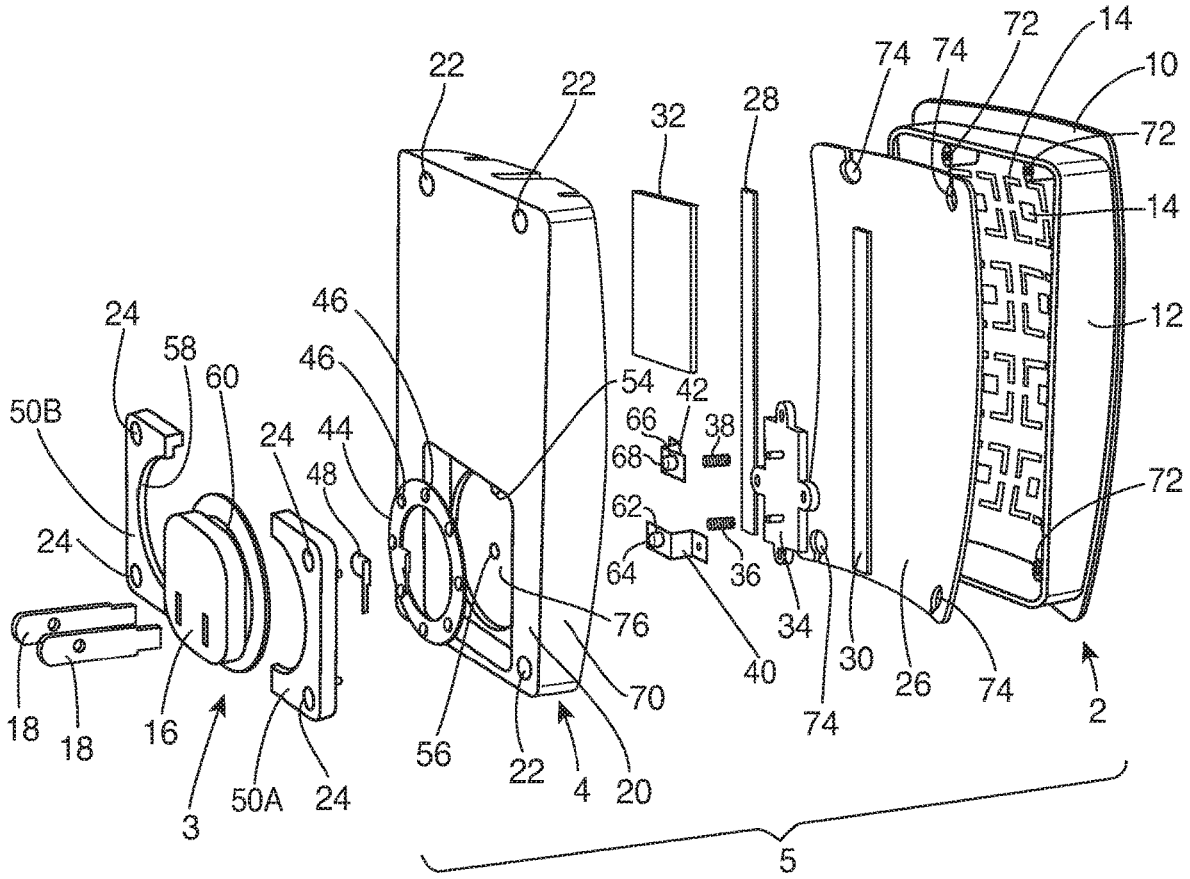

FIG. 11 is an exploded rear perspective view of elements comprising an embodiment of a night light rotatable to expose or conceal outlet in accordance with the present invention.

Figure 12:
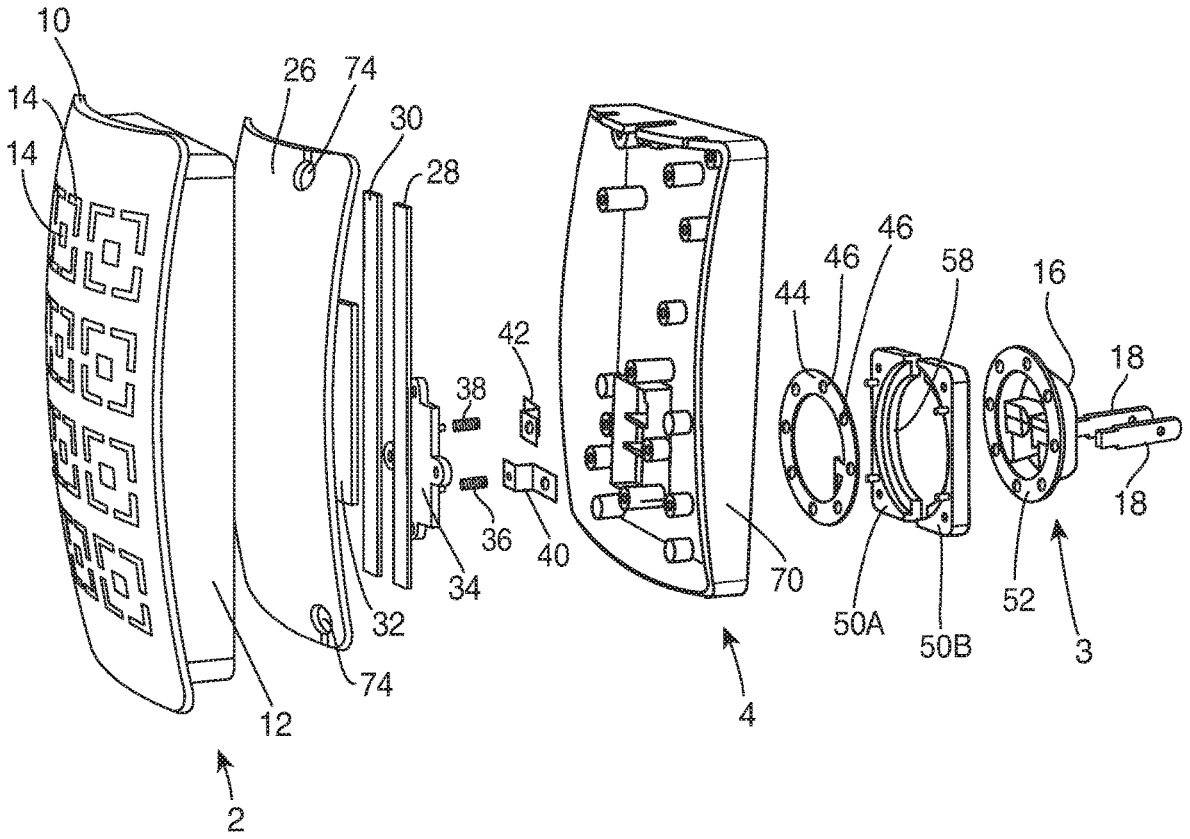

FIG. 12 is an exploded front perspective view of elements comprising an embodiment of a night light rotatable to expose or conceal outlet in accordance with the present invention.

DETAILED DESCRIPTION OF THE INVENTION

In the following, various embodiments of the invention are described more fully in reference to the drawings, in which some, but not all embodiments of the invention are shown in the figures. The described embodiments are merely a few examples of the embodiments of the invention. The invention may be embodied in many different forms and should not be construed as limited to the embodiments as set forth herein. All other embodiments obtained by those skilled in the art based on the embodiments of the invention described, pictured or claimed herein are within the scope of the present invention.

The invention is a night light 1 which plugs into an electrical outlet 80. In a preferred embodiment, while the night light 1 remains plugged into an electrical outlet 80, the body 5 of the night light 1 is rotatable around an axis that extends perpendicularly from the face of the electrical outlet 80 into which the night light 1 is plugged (hereinafter referred to as the rotation axis 78). The body 5 of the night light 1 is so rotatable through 360 degrees. In one orientation, the body 5 of the night light 1 conceals the view of the electrical receptacle 100 into which the night light 1 is plugged. In another orientation, an electrical outlet 102 of the electrical receptacle 100 is exposed for use by another electrical device.

In a preferred embodiment, the night light 1 comprises an enclosure 4 in which the light source and the electrical circuitry supporting the light source are housed, a cover 2 of the enclosure 4 through which light from the light source is transmitted from the interior of the night light 1 to the environment outside of the night light 1, and a plug assembly 3 that rotates in relation to the enclosure 4 and cover 2. The night light body 5 is comprised of the enclosure 4 and cover 2.

Figure 1:
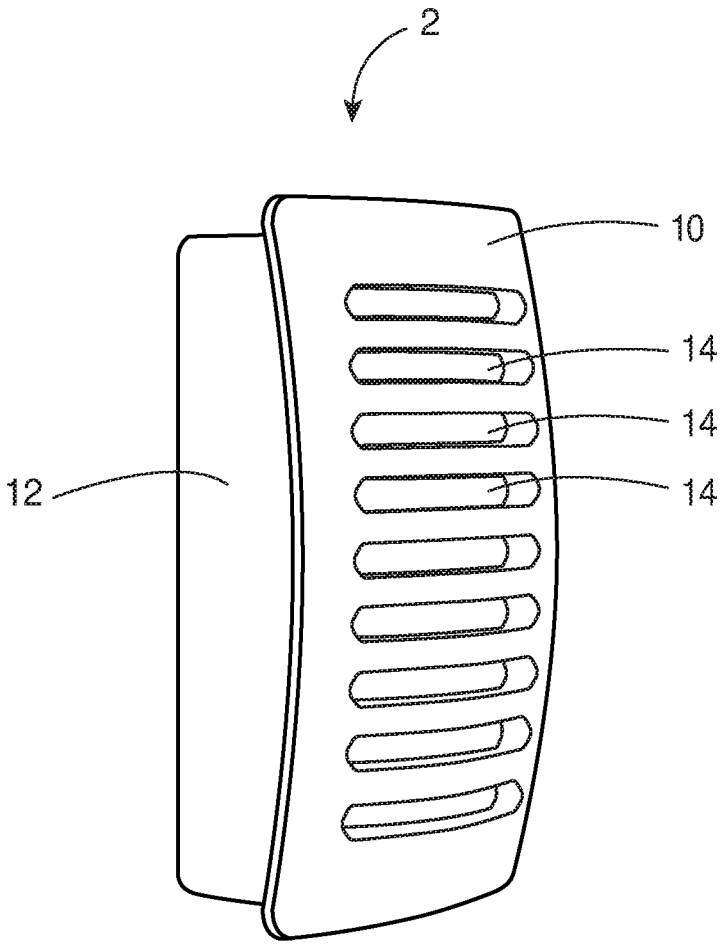
FIG. 1 is a perspective view of a night light rotatable to expose or conceal outlet in accordance with the present invention.

FIGS. 1-6, show the exterior appearance of a preferred embodiment of the invention. With reference to FIG. 1, there is shown a sidewall perspective view of a cover 2 to the body 5 of the night light 1 comprising a front face 10 and a perimeter 12 extending rearward from the front face 10 in an orientation approximately perpendicular to the front surface of the front face 10. Front face 10 has length and width dimensions that are approximately the same as those of a perimeter of the electrical receptacle 100 into which the night light 1 is plugged. One or both of the front face 10 length and width dimensions can be greater than the approximate length and width dimensions of the electrical receptacle 100. It is preferable to form the cover 2 from a single piece of material, but the front face 10 and the perimeter 12 can be formed from multiple pieces of material or from different materials. It is preferable that the cover 2 be a plastic material, but other materials can be used. The front face 10 of the cover 2 includes cut outs 14 that allow light from the light source in the interior of the night light body 5 to be transmitted to the exterior of the night light body 5. Alternative embodiments can have other means of transmitting light from the interior of the night light body 5 to the exterior of the night light body 5, including having a front face 10 comprised of translucent material. Alternative embodiments can have the front face 10 be a material that itself emits light.

Figure 2:
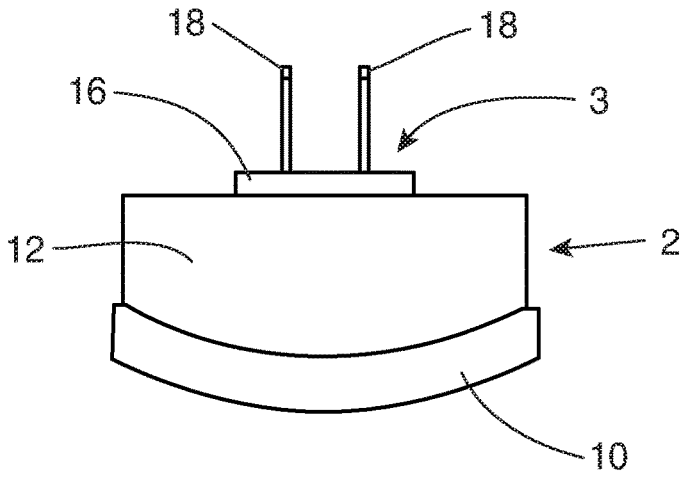
FIG. 2 is a top view of a night light rotatable to expose or conceal outlet in accordance with the present invention.
Figure 3:
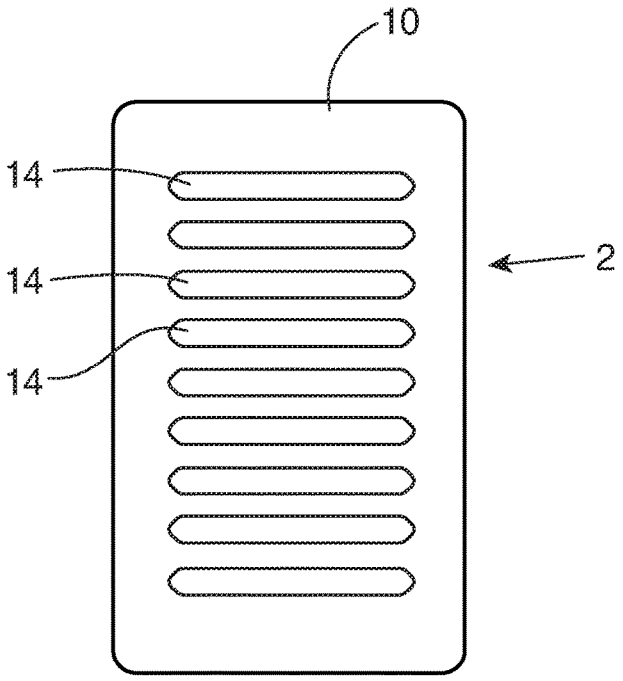
FIG. 3 is a front view of a night light rotatable to expose or conceal outlet in accordance with the present invention.
Figure 4:
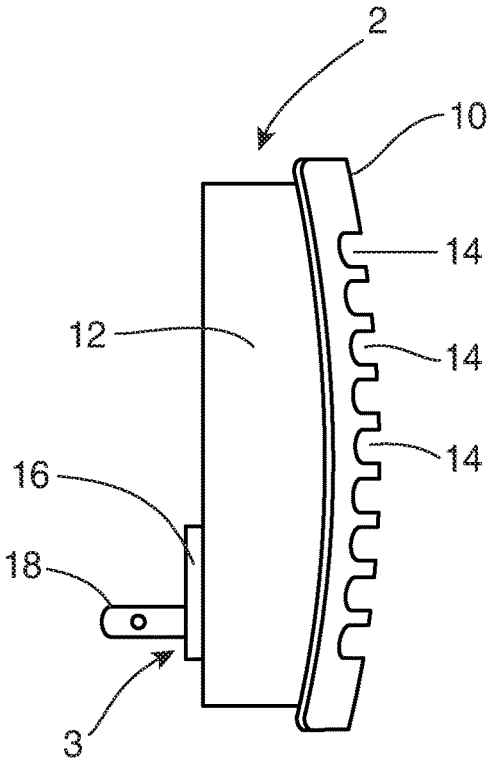
FIG. 4 is a side view of a night light rotatable to expose or conceal outlet in accordance with the present invention.
Figure 5:
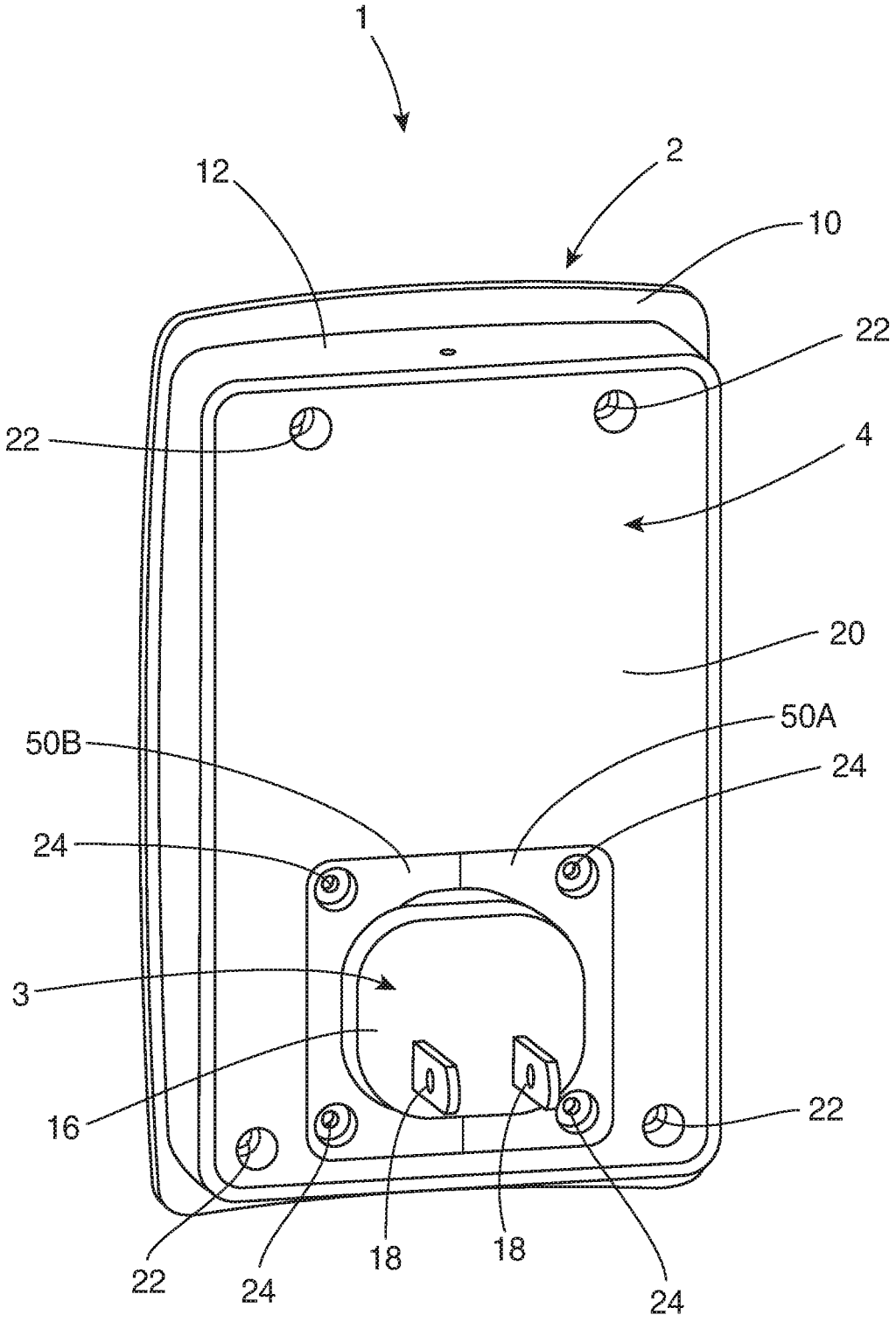
FIG. 5 is a rear perspective view of a night light rotatable to expose or conceal outlet in accordance with the present invention.
Figure 6A:
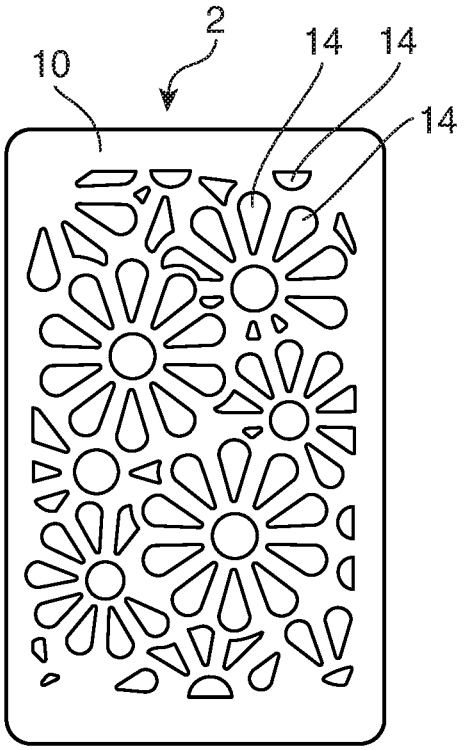
FIG. 6A is an example of a decorative pattern that can comprise the outer surface of the night light cover in accordance with the present invention.
Figure 6B:
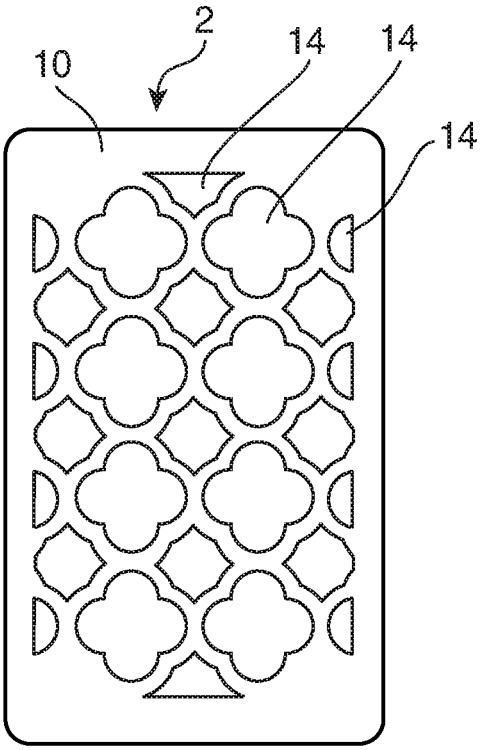
FIG. 6B is an example of a decorative pattern that can comprise the outer surface of the night light cover in accordance with the present invention.
Figure 6C:
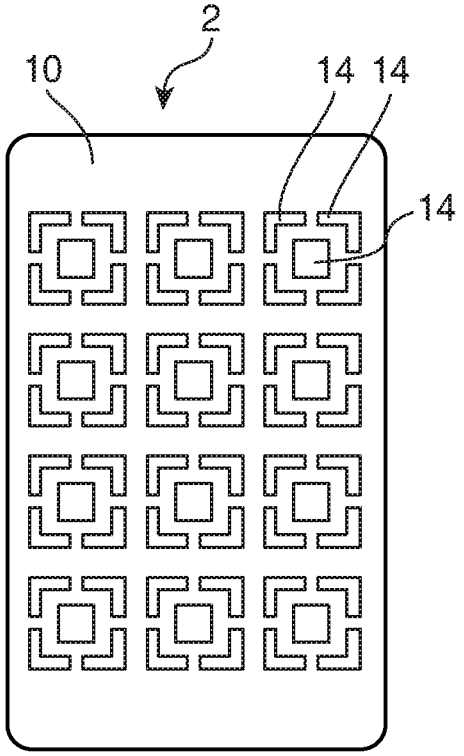
FIG. 6C is an example of a decorative pattern that can comprise the outer surface of the night light cover in accordance with the present invention.
Figure 6D:
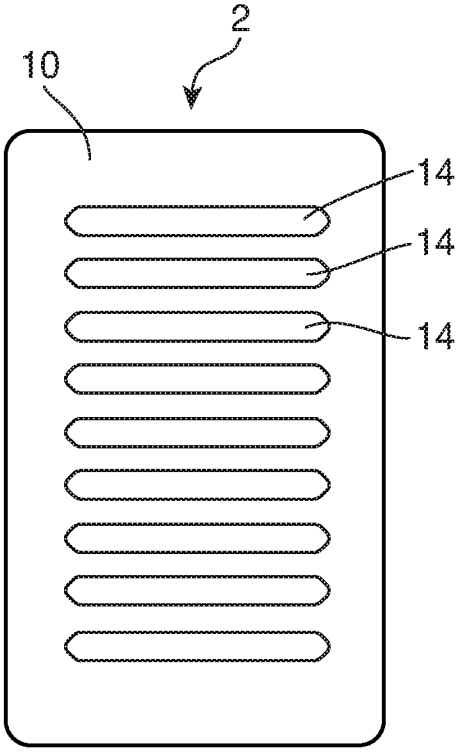
FIG. 6D is an example of a decorative pattern that can comprise the outer surface of the night light cover in accordance with the present invention.

FIG. 3 is a front view of a night light cover 2 comprising a front face 10 and cut outs 14. FIG. 2 is a top view of a night light cover 2 comprising the top view of the front face 10, and the face of the top rearward extending perimeter 12 of the cover 2. FIG. 2 also shows the top view of a non-conductive plug body 16 which secures electrically conductive prongs 18 which are insertable into an electrical outlet 80. FIG. 4 is a side view of a night light cover 2 comprising the side view of a front face 10 and the face of a side rearward extending perimeter 12 of the cover 2. FIG. 4 also shows the side view of a non-conductive plug body 16 which secures electrically conductive prongs 18 which are insertable into an electrical outlet 80. FIG. 5 is a rear perspective view of a night light body 5 comprised of the rear side of the front face 10 of the night light body cover 2, the four rearward extending sides of the perimeter 12 of the cover 2, the rear surface 20 of an enclosure 4, electrically conductive prongs 18 that are insertable into an electrical outlet 80, a non-conductive plug body 16, and a retention plate 50A and 50B that holds the non-conductive plug body 16 in contact with the night light body enclosure 4.

FIGS. 6A-6D show four examples of the many decorative patterns that can comprise the front face 10 of the night light cover 2. The embodiments in FIGS. 6A-6D depict cut outs 14 of the front face 10 which allow light to be transmitted from the interior of the night light body 5 to the exterior of the night light body 5. Alternative embodiments can have other means of transmitting light from the interior of the night light body 5 to the exterior of the night light body 5, including having a front face 10 comprised of translucent material. Decorative patterns can be displayed on the front face 10 of the night light cover 2 by varying the translucency of the front face 10 to form such patterns.

FIGS. 7-10 show the transition of a night light 1 from an orientation in FIG. 7 in which an electrical outlet 102 of the electrical receptacle 100 is exposed for use by another electrical device, to an orientation in FIG. 10 in which the body 5 of the night light 1 conceals the view of the electrical receptacle 100 into which the night light 1 is plugged. The night light 1 remains plugged into an electrical outlet 80 during the night light's 1 transition from the orientation shown in FIG. 7 to the orientation shown in FIG. 10. During the transition, the body 5 of the night light 1 rotates around the rotation axis 78. The body 5 of the night light is so rotatable through 360 degrees. The described transition from an orientation in which an electrical outlet 102 of the electrical receptacle 100 is exposed for use by another electrical device, to an orientation in which the body 5 of the night light 1 conceals the view of the electrical receptacle 100 into which the night light 1 is plugged is accomplished in the same manner regardless of the outlet of the receptacle 100 into which the night light 1 is plugged.

In reference to FIGS. 11-12, the preferred embodiment of the invention comprises a night light body 5 and an electrical plug structure 3 that enables the night light body 5 to move in a 360 degree arc around the rotation axis 78 while the plug structure 3 remains electrically engaged in an electrical outlet 80 of an electrical receptacle 100. A night light body 5 comprises an enclosure 4 having a rear surface 20 and four perimeter sides 70 extending forward from the perimeter of that rear surface 20 to form an enclosure. It is preferable to form the enclosure 4 from a single piece of material, but it can be formed from multiple pieces of material or from different materials. It is preferable that the enclosure 4 be a plastic material, but other materials can be used. A night light body 5 is also comprised of a cover 2 having a front face 10 with four perimeter sides 12 extending rearward from that front face 10 to form a cover. The cover 2 is engaged with the enclosure 4 by sliding the perimeter sides 12 of the cover 2 over the outside surfaces of the perimeter sides 70 of the enclosure 4 to form the night light body 5; that engagement is secured with fastening devices such as screws, 22 (FIG. 5). Other fastening methods and devices can be used.

The light source 30 is contained within the night light body 5. The light source 30 can be a LED, a plurality of LEDs, an incandescent light or any other light emitting device or material. In the preferred embodiment, a light transmission plate 26 is arranged between the night light enclosure 4 and the night light cover 2. One or more protrusions 72 in the night light cover 2 pass through one or more circular holes 74 on the light transmission plate 26 to engage the night light transmission plate 26. One side of the light transmission plate 26 is provided with a circuit board 28, and the light transmission plate 26 is attached to the circuit board 28. One side of the circuit board 28 is provided with a patch LED 30, one side of the patch LED 30 is provided with a main circuit board 32. Light generated and emitted by the operation and interaction of circuit board 28, patch LED 30 and circuit board 32, is transmitted through transmission plate 26 and through cut outs 14 of the front surface 10 of the night light cover 2. The electrical circuit which generates and emits light, comprised of circuit board 28, patch LED 30 and circuit board 32, can include circuitry that converts alternating current electricity to direct current electricity, can include circuitry that turns the light source 30 on or off based on inputs from a sensor that measures ambient light levels, and can include circuitry that turns the light source 30 on or off based on inputs from a sensor which receives inputs from a remote device.

The light source 30 within the night light body 5 is energized by electrical energy from a standard electrical receptacle 100. The structures referred to herein as being electrically conductive are preferably comprised of copper material, but can be made of conductive materials other than copper. An electrical plug structure 3 comprises electrically conductive prongs 18 that are insertable into an outlet 80 of a standard electrical receptacle 100. The prongs 18 are securely held in a non-conductive plug body 16. The plug body 16 can include a retaining tab as disclosed in U.S. Pat. No. 5,727,953 to Pasholk, or other equivalent or similar structures, to restrict the unintended removal of the night light 1 from electrical outlets. The plug body 16 includes a channel 60, the bed of which is circular in the plane which is perpendicular to the axis of rotation 78; the circle of the bed is centered on the axis of rotation 78. A retaining structure consisting of two parts 50A and 50B, includes a circular collar 28 which fits within the channel 60 of the plug body 16. The retaining structure 50A and 50B is attached to the rear of the enclosure 4, with screws 24 or other similar fastening devices. The collar 28 in the channel 60 connects the plug structure 16 to the retaining structure 50A and 50B, and in turn, to the night light body 5, while allowing the plug structure 16 to rotate in a 360 degree arc around the rotation axis 78 in relation to the retaining structure 50A and 50B and the night light body 5.

A first conductive member 48 is connected to one of the prongs 18, within the plug body 16. The first conductive member 48 extends out of the plug body 16 toward the rear of the enclosure 4 and is configured to end in an electrical contact that is centered on the axis of rotation 78 and is immediately adjacent to a first hole 56 in a rear surface 76 of the night light enclosure 2. A second conductive member 44 is connected within the plug body 16 to the prong 18 that is not connected to the first conductive member 48. The second conductive member 44 extends out of the plug body 16 toward the rear of the enclosure 4 where it is configured as a ring. The ring portion of the second conductive member 44 is attached to the forward surface 58 of the plug body 16. The ring portion of the second conductive member 44 is fixed in relation to the plug body 16, and rotates around the axis of rotation 78 concurrently with the plug body 16. A portion of the ring portion of the second conductive member 44 is always immediately adjacent to a second hole 54 in a rear surface 76 of the night light enclosure 4. The ring portion of the second conductive member 44 has a plurality of indentations 46 extending into the ring from the front. The indentations 46 are located on the ring portion of the second conductive member 44 to line up with the second hole 54 as each such indentation 46 passes the hole 54 as the plug body 16 rotates in relation to the night light body 5.

A third conductive member 40 has a protrusion 62 with a hemispherical end 64 which extends through hole 56 from the interior of the night light body 5 and contacts first conductive member 48. Conductive member 40 is held in contact with conductive member 48 with a spring 36. Spring 36 is held in place by a non-conductive retaining structure 34. In an alternative embodiment, spring 36 could be eliminated and conductive member 40 could be a leaf spring held in place by a non-conductive retaining structure 34. A fourth conductive member 42 has a protrusion 66 with a hemispherical end 68 which extends through hole 54 from the interior of the night light body 5 and contacts conductive member 44. Conductive member 42 is held in contact with conductive member 44 with a spring 38. Spring 38 is held in place by a non-conductive retaining structure 34. Retaining structure 34 is connected to enclosure 3 with screws or other fastening devices. In an alternative embodiment, spring 38 could be eliminated and conductive member 42 could be a leaf spring held in place by a non-conductive retaining structure 34. Conductive member 40 connects through a wire or other electrically conductive structure to one end of the electrical circuit which generates and emits light comprised of circuit board 28, patch LED 30 and circuit board 32 within the night light body 5. Conductive member 42 connects through a wire or other electrically conductive structure to the opposite end of the electrical circuit which generates and emits light comprised of circuit board 28, patch LED 30 and circuit board 32.

As conductive member 44 rotates around the rotation axis 78, its plurality of indentations 46 sequentially engage with the hemispherical end 68 of the protrusion 66 of conductive member 42. When so engaged, the rotational orientation of the night light body 5 in relation to the plug body 16 is maintained. Among the plurality of indentations 46 are indentations that will engage with the hemispherical end 68 of the protrusion 66 of conductive member 42 to maintain the night light body 5 in relation to an electrical receptacle 100 in the orientations shown in FIGS. 7 and 10. The orientation of the night light body 5 in relation to the plug body 16 can be changed by manually rotating the night light body 5 around the rotational axis 78 while the plug body 16 remains engaged in the receptacle 100 outlet 80.

While particular embodiments of the invention have been shown and described, it will be obvious to those skilled in the art that changes and modification may be made without departing from the invention in its broader aspects, and therefore, the aim in the appended claims is to cover all such changes and modifications as fall within the true spirit and scope of the invention.

Accordingly, the embodiments are to be considered as illustrative and not restrictive from any point of view. All of the modifications and changes falling within the scope defined by the claims should be encompassed by the scope of the invention. In addition, it should be understood that although this specification is described in terms of embodiments, not every embodiment includes only one independent technical solution. The description is merely for the sake of clarity; one skilled in the art should refer to the specification as a whole. In addition, the technical solutions in the embodiments may also be suitably combined to form other embodiments which will be understood by those skilled in the art.

We claim:

1. A night light rotatable to expose or conceal outlet that plugs into an electrical receptacle comprising:

a plug structure;

a body structure which includes at least one light source energized through said plug structure; said body structure having perimeter dimensions that equal or exceed the perimeter dimensions of the electrical receptacle into which said night light is plugged; and a means that enables said body structure to move in combination with and relative to said plug structure without unplugging said night light, and while maintaining electrical energization of said at least one light source, from a first orientation in which said body structure conceals from view the entire electrical receptacle, to a second orientation in which said body structure exposes one of the electrical receptacle's outlets for use, and from said second orientation in which said body structure exposes one of the electrical receptacle's outlets for use, to said first orientation in which said body structure conceals from view the entire said electrical receptacle.

2. The night light rotatable to expose or conceal outlet that plugs into an electrical receptacle of claim 1 wherein:

said at least one light source is a LED.

3. The night light rotatable to expose or conceal outlet that plugs into an electrical receptacle of claim 1 wherein:

said at least one light source is an electroluminescent material.

4. The night light rotatable to expose or conceal outlet that plugs into an electrical receptacle of claim 1 further comprising:

said at least one light source coupled to a sensor that turns the light source on or off based on ambient light levels.

5. The night light rotatable to expose or conceal outlet that plugs into an electrical receptacle of claim 1 further comprising:

said at least one light source coupled to a sensor that turns the light source on or off based on wireless inputs from a remote device.

6. A night light rotatable to expose or conceal outlet that plugs into an electrical receptacle comprising:

a plug structure;

a body structure which includes at least one light source energized through said plug structure; said body structure having perimeter dimensions that equal or exceed the perimeter dimensions of the electrical receptacle into which said night light is plugged; and a connector assembly between said plug structure and said body structure so that said body structure moves in combination with and relative to said plug structure without unplugging said night light, and while maintaining electrical energization of said at least one light source, from a first orientation in which said body structure conceals from view the entire electrical receptacle, to a second orientation in which said body structure exposes one of the electrical receptacle's outlets for use, and from said second orientation in which said body structure exposes one of the electrical receptacle's outlets for use, to said first orientation in which said body structure conceals from view the entire said electrical receptacle.

7. The night light rotatable to expose or conceal outlet that plugs into an electrical receptacle of claim 6 wherein:

said at least one light source is a LED.

8. The night light rotatable to expose or conceal outlet that plugs into an electrical receptacle of claim 6 wherein:

said at least one light source is an electroluminescent material.

9. The night light rotatable to expose or conceal outlet that plugs into an electrical receptacle of claim 6 further comprising:

said at least one light source coupled to a sensor that turns said light source on or off based on ambient light levels.

10. The night light rotatable to expose or conceal outlet that plugs into an electrical receptacle of claim 6 further comprising:

said at least one light source coupled to a sensor that turns said light source on or off based on wireless inputs from a remote device.

11. The night light rotatable to expose or conceal outlet that plugs into an electrical receptacle of claim 6 wherein:

said connector assembly comprises:

an annular conductor with a plurality of indentations fixedly attached to said plug body in an orientation parallel to the surface of said electrical receptacle and electrically connected to a first conductive prong;

a second conductor electrically connected to a second conductive prong and fixedly attached to said plug body on the axis of rotation of said body structure;

a tongue-in-groove collar coupled with said plug structure to attach said plug structure to said body structure;

a third conductor connected on a first end to a first end of the electrical circuitry in said body structure, and on a second end in electrical contact with said second conductor, said second end being held in contact with the second conductor by a spring;

a fourth conductor connected on a first end to a second end of said electrical circuitry in said body structure, and on a second end in electrical contact with said first conductor, said contact occurring through a hemispherical end of said fourth conductor, and said second end being held in contact with said first conductor by a spring.

12. The night light rotatable to expose or conceal outlet that plugs into an electrical receptacle of claim 11 wherein:

said at least one light source is a LED.

13. The night light rotatable to expose or conceal outlet that plugs into an electrical receptacle of claim 11 wherein:

said at least one light source is an electroluminescent material.

14. The night light rotatable to expose or conceal outlet that plugs into an electrical receptacle of claim 11 further comprising:

said at least one light source coupled to a sensor that turns said light source on or off based on the ambient light levels.

15. The night light rotatable to expose or conceal outlet that plugs into an electrical receptacle of claim 11 further comprising:

said at least one light source coupled to a sensor that turns said light source on or off based on wireless inputs from a remote device.

16. A method of converting a night light from a first orientation in which said night light body structure conceals from view the entire electrical receptacle, to a second orientation in which one of the electrical receptacle's outlets is exposed for use, and from said second orientation to said first orientation, without unplugging the night light, and while maintaining electrical energization of said at least one light source, comprising:

providing a night light comprising a body structure having perimeter dimensions that equal or exceed the perimeter dimensions of the electrical receptacle into which said night light is plugged, a plug structure and a connector assembly between said body structure and said plug structure so that said body structure moves in combination with and relative to said plug structure around an axis that is perpendicular to said electrical receptacle;

plugging said night light into said electrical receptacle;

without unplugging said night light, manually rotating said body structure around said axis until said body structure is in said first orientation in which said body structure conceals from view the entire electrical receptacle;

without unplugging said night light, manually rotating said body structure around said axis until said body structure is in said second orientation in which said body structure exposes one of the electrical outlets for use; and without unplugging said night light, manually rotating said body structure around said axis until said body structure is in said first orientation in which said body structure conceals from view the entire electrical receptacle.

* * * * *